United States Patent [19]

Moore

[11] Patent Number: 4,696,576

[45] Date of Patent: Sep. 29, 1987

[54] FOOD SERVICE TICKET TIMER

[76] Inventor: Frankie A. Moore, P.O. Box 9422, Columbus, Ga. 39108

[21] Appl. No.: 929,732

[22] Filed: Nov. 12, 1986

[51] Int. Cl.[4] ..... G04F 8/00

[52] U.S. Cl. ..... 368/10; 368/109

[58] Field of Search ..... 368/1, 3, 9, 10, 12, 368/72–74, 107–109, 243, 256

[56] References Cited

U.S. PATENT DOCUMENTS 5,943,694 3/1976 Hofer ..... 368/256

*Primary Examiner*—Vit W. Miska

[57] ABSTRACT

A control board containing a row of electric timers, each of which is activated by an inserted ticket and a lamp activated by each timer.

1 Claim, 3 Drawing Figures

FOOD SERVICE TICKET TIMER

BACKGROUND OF THE INVENTION

1. Field of the Invention

This invention relates generally to fast food service industry. More specifically, it relates to a system for the filling out of patron's food orders in a fast food restaurant establishment.

2. Description of Prior Art

It is well known that persons who patronize fast food restaurant establishments do not expect to receive a relaxing leisurely slow service in being served their order of food. Fast food chains have been developed particularly to service people who are busy, are in a hurry or who simply limit the time allowed for eating a meal in a restaurant. Nevertheless, although they expect fast service, it sometimes happens to be too slow, especially during rush hours when many orders are placed rapidly so that some orders get mistakenly delayed behind others instead of being filled in proper order of being received. This can be annoying to persons having only a limited time, so that this situation is accordingly in need of an improvement.

SUMMARY OF THE INVENTION

Therefore, it is a principal object of the present invention, to provide a food service ticket timer whereby service workers in a fast food establishment are made aware of the amount of passing time between when an order is placed and when the same order is filled.

Another object is to provide a fast service ticket timer that records the amount of time used or needed in preparing fast foods. This also aids the service personnel to get out at the same time a service to a large party wherein some orders take more time than others, thus allowing insertion meantime of fast service to still other patrons. This also aids patrons to know in advance how soon they can expect to get their filled orders.

Yet another object is to provide a fast service ticket timer which may be made adaptable for other industries wherein patrons must wait while patrons ahead of them are being attended.

These and other objects will be readily evident upon a study of the following Specification and the accompanying Drawing.

DETAILED DESCRIPTION

Figure 1:
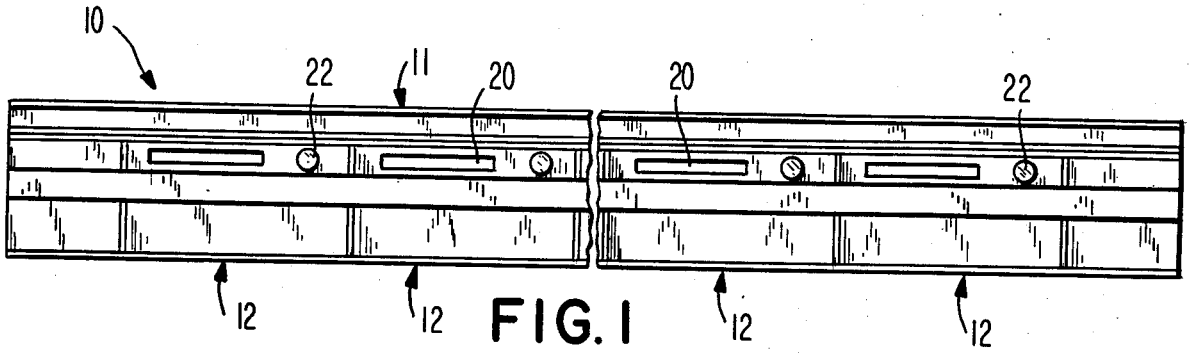
FIG. 1 is a front elevational view of a multiple food service ticket timer shown in accordance with the present invention.
Figure 2:
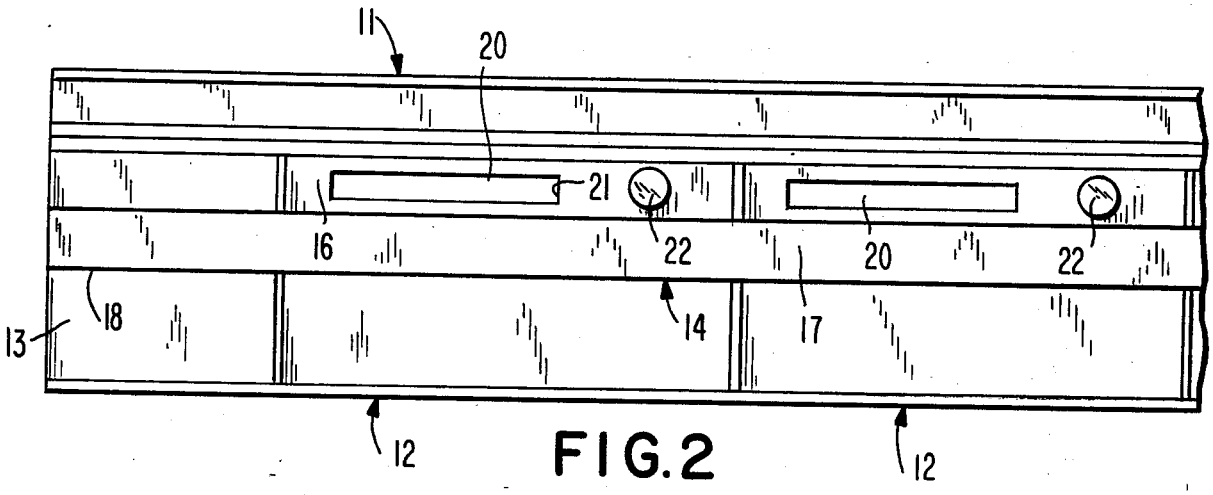
FIG. 2 is an enlarged front elevational view of two typical stations.
Figure 3:
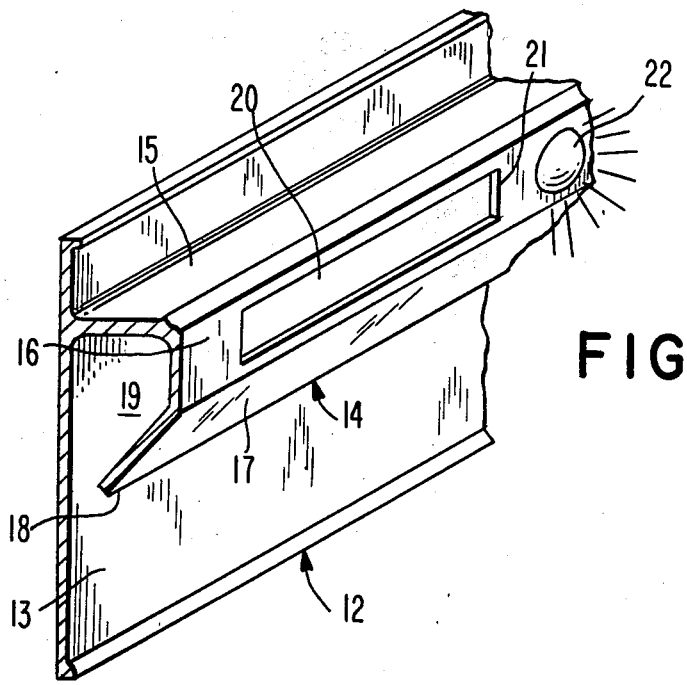
FIG. 3 is a fragmentary perspective view of a typical station.

Referring now to the Drawing in greater detail, the reference numeral 10 represents a fast service ticket timer incorporating the invention which comprises a control panel installed inside a business establishment, and which includes a row or bank 11 of individual units 12 each one of which serves to time an individual order. Each unit includes a vertical rear panel 13 and a clip 14 being formed directly in front thereof which are both extruded or molded together from a single piece of metal or plastic. The clip includes a horizontal top wall 15, a vertically downward front wall 16 extending therefrom, and an angularly rearwardly downward lip or holding bar 17 extending from the wall 16. The lower edge 18 of the holding bar is relatively close to the panel 13 so that an upper edge of a timer ticket (not shown) may be clipped therebetween while the ticket hangs downward therefrom. Thus the clip comprises a forwardly protrusion on the panel that rolls around a space 19 into which the upper edge of the timer ticket extends.

An electronic timer 20 is mounted inside the front wall 16 as shown in window 21. An L.E.D. lamp 22 is also mounted on the front wall and is electrically connected to the timer. The lamp and the timer are in electrical circuit with a plug (not shown) for attachment to an electric power source.

In order to activate the electrical circuit a timer ticket must be inserted between the clip edge and the panel, thus starting the timing process for the specific unit receiving the ticket. Upon the timer ticket there are written the list of food items ordered by a person or a party for comprising a meal.

In a conventional fast food restaurant, the orders are written on a slip of paper that is then hung up in front of the kitchen area where the service persons can read it for preparing the order. Thus the present invention is also located where it may be quickly consulted by them during their work. The timing process is started by the inserted ticket tripping an electric switch on the timer 20 The timer is set to close the circuit to the L.E.D. lamp after a period of ten minutes (or other time set by the establishment) has elapsed and by when the order should have been ready for being now served to the customer. The lamp remains lighted until the ticket is finally removed for accompanying the food to the customer.

While various changes may be made in the detail construction, it is to be noted that such changes will be within the spirit and scope of the present invention as is defined by the appended claims.

What I now claim is:

1. A fast service ticket timer, comprising, a control board having a row units, each unit including an electrical timer in a circuit, and means for closing said circuit at a set time after a meal order has been received, and comprising a timer ticket having said meal order written thereon, and each said unit being adaptable to receive said ticket, and said ticket closing said circuit.

* * * * *